US005462441A

United States Patent [19]

Renn et al.

[11] Patent Number: 5,462,441

[45] Date of Patent: Oct. 31, 1995

[54] LOW PROFILE ELECTRICAL CONNECTOR

[76] Inventors: Robert M. Renn, 1901 Turfwood Dr., Pfafftown, N.C. 27040; Keith L. Volz, 601 O'Neill Dr., Jamestown, N.C. 27282

[21] Appl. No.: 250,268

[22] Filed: May 27, 1994

[51] Int. Cl.[6] ..... H01R 9/09

[52] U.S. Cl. ..... 439/67; 439/495

[58] Field of Search ..... 439/67, 77, 492, 439/493, 495

[56] References Cited

U.S. PATENT DOCUMENTS

| | | | |
|---|---|---|---|
| 4,023,878 | 5/1977 | Hennessey | 439/67 |
| 4,060,889 | 12/1977 | Zielinski | 439/67 |
| 4,169,641 | 10/1979 | Olsson | 439/67 |
| 4,181,386 | 1/1980 | Olsson | 439/493 |
| 4,252,389 | 2/1981 | Olsson | 439/67 |
| 4,252,392 | 2/1981 | Whiteman, Jr. | 439/67 |
| 4,330,163 | 5/1982 | Aikens et al. | 439/71 |
| 4,334,728 | 6/1982 | Reynolds et al. | 439/67 |
| 4,634,195 | 1/1987 | Shoemaker | 439/67 |
| 4,684,183 | 8/1987 | Kinoshita et al. | 439/77 |
| 4,695,258 | 9/1987 | Hanson et al. | 439/67 |
| 4,936,792 | 6/1990 | Onoue et al. | 439/329 |
| 4,944,690 | 7/1990 | Imai | 439/492 |
| 4,948,379 | 8/1990 | Evans | 439/329 |

FOREIGN PATENT DOCUMENTS 3-155070 7/1991 Japan .

*Primary Examiner*—Neil Abrams
*Attorney, Agent, or Firm*—William Noll; Timothy Aberle

[57] ABSTRACT

The invention is directed to a low profile electrical connector (10) for mounting a flexible film (60) having circuitry thereon, for electrical interconnection to a planar electronic device, such as a PCB (42), upon which the connector is to be mounted. The connector comprises an elongated dielectric housing (16) defined by essentially upper and lower parallel surfaces (18,20), a central through slot (26) for extending between the upper and lower surfaces (18,20) and end portions (22,24) for receiving an electrical interface member (62), such as an elastomeric connector known as AMPLIFLEX. Further means for mounting the housing to the planar electronic device, and means along one of the surfaces (18) for receiving a spring actuator member (14), are provided. The spring actuator member (14) comprising a stamped and formed metal member channel shaped at its ends (44,46) to slidable receive the end portions (22,24) of the dielectric housing, and a mid portion (48) having an extension (56) therefrom adapted to be deflected to effect opening of the end portions (44,46). Finally, an elastomeric connector 62, comprising an elastomeric core having a flexible film wrapped thereabout, where the film includes electrical circuitry thereon, positioned within the central through slot (26) to electrically interconnect the flexible film (60) disposed within the low profile connector to the planar electronic device (42).

8 Claims, 5 Drawing Sheets

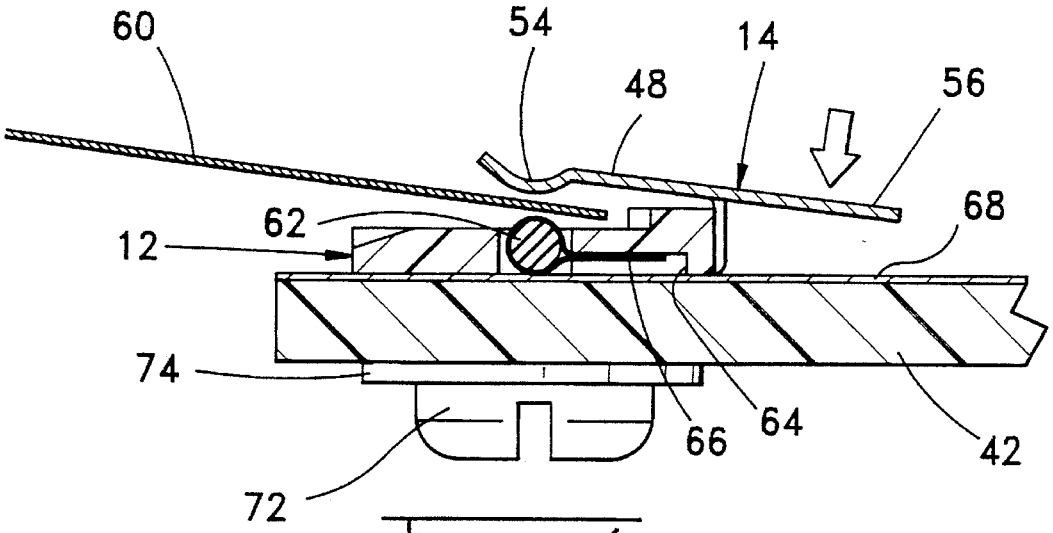
Fig. 4
Fig. 5
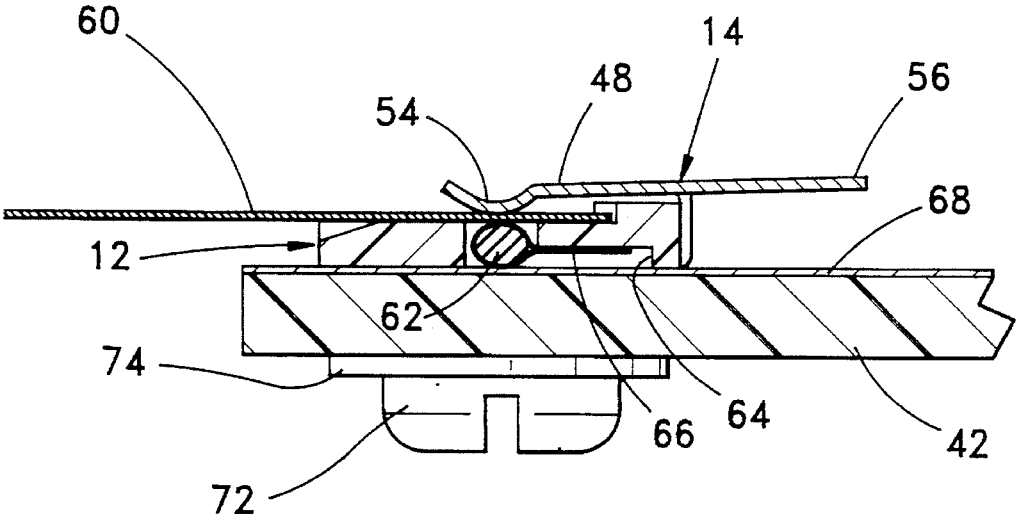

LOW PROFILE ELECTRICAL CONNECTOR

BACKGROUND OF THE INVENTION

This invention is directed to a low profile electrical connector of the type for electrically interconnecting a flexible film, having electrical circuitry thereon, to a planar electronic device, such as a printed circuit board (PCB).

With future requirements for computers and other communication equipment placing a premium on space, it was critical to develop an electrical connector that would satisfy this need. Dimensionally, little space is required above the PCB.

U.S. Pat. No. 4,936,792, assigned to the assignee hereof, teaches an electrical connector for flexible printed cable, where the cable enters laterally into the connector housing and the connector housing includes a pivotally mounted cover member which moves from an open position to allow entry of the cable to a closed position to effect electrical engagement with the cable.

The manner by which the present invention provides for a cost effective low profile connector will become apparent to those skilled in the art from reading the following specification, particularly when read in conjunction with the accompanying drawings.

SUMMARY OF THE INVENTION

This invention relates to a low profile electrical connector for mounting a flexible film having circuitry thereon for electrical interconnection to a planar electronic device, such as a printed circuit board, upon which the connector is to be mounted. The connector comprises an elongated dielectric housing, defined by essentially upper and lower parallel surfaces, a central through slot for extending between the upper and lower surfaces and end portions for receiving an electrical interface member. Further, means are provided for mounting the housing to the planar electronic device, and means along one of the surfaces are provided for receiving a spring actuator member. Cooperating with the housing is a spring actuator member comprising a stamped and formed metal member channel shaped at its ends to slidably receive the end portions of the dielectric housing, and a mid portion having an extension therefrom adapted to be deflected to effect opening or spreading of the end portions. Finally, an elastomeric connector is included in the through slot. Such elastomeric connector comprises an elastomeric core having a flexible film wrapped thereabout, where the film includes electrical circuitry thereon. By positioning the elastomeric connector within the central through slot, electrically interconnection is achieved between the flexible film and the planar electronic device.

BRIEF DESCRIPTION OF THE DRAWINGS

FIG. 3 is a further exploded, perspective view of the partially assembled connector of FIG. 1, additionally illustrating an exemplary PCB and the fastening means for mounting the connector to the PCB.

FIGS. 4 and 5 are partial, lateral sectional views illustrating the positions of loading and securing, respectively, a flexible film within the connector.

DETAILED DESCRIPTION OF PREFERRED EMBODIMENT

The invention covers a low profile electrical connector of the type for receiving a flexible film having circuitry thereon,.where the connector is mounted on a planar electronic device, such as a printed circuit board (PCB). Electrical interconnection between the flexible film and the PCB is preferably accomplished by the use of a flexible elastomeric electrical connector. A commercial version thereof is AMPLIFLEX, a registered trademark of The Whitaker Corporation, Wilmington, Del., and licensed to AMP Incorporated, Harrisburg, Pa. AMPLIFLEX connectors, suited for high density, surface mount applications, consist of a thin flexible polyamide film, having on its surface etched copper circuitry plated with gold over nickel, where the film is wrapped around a soft, non-conducting silicone core.

Figure 1:
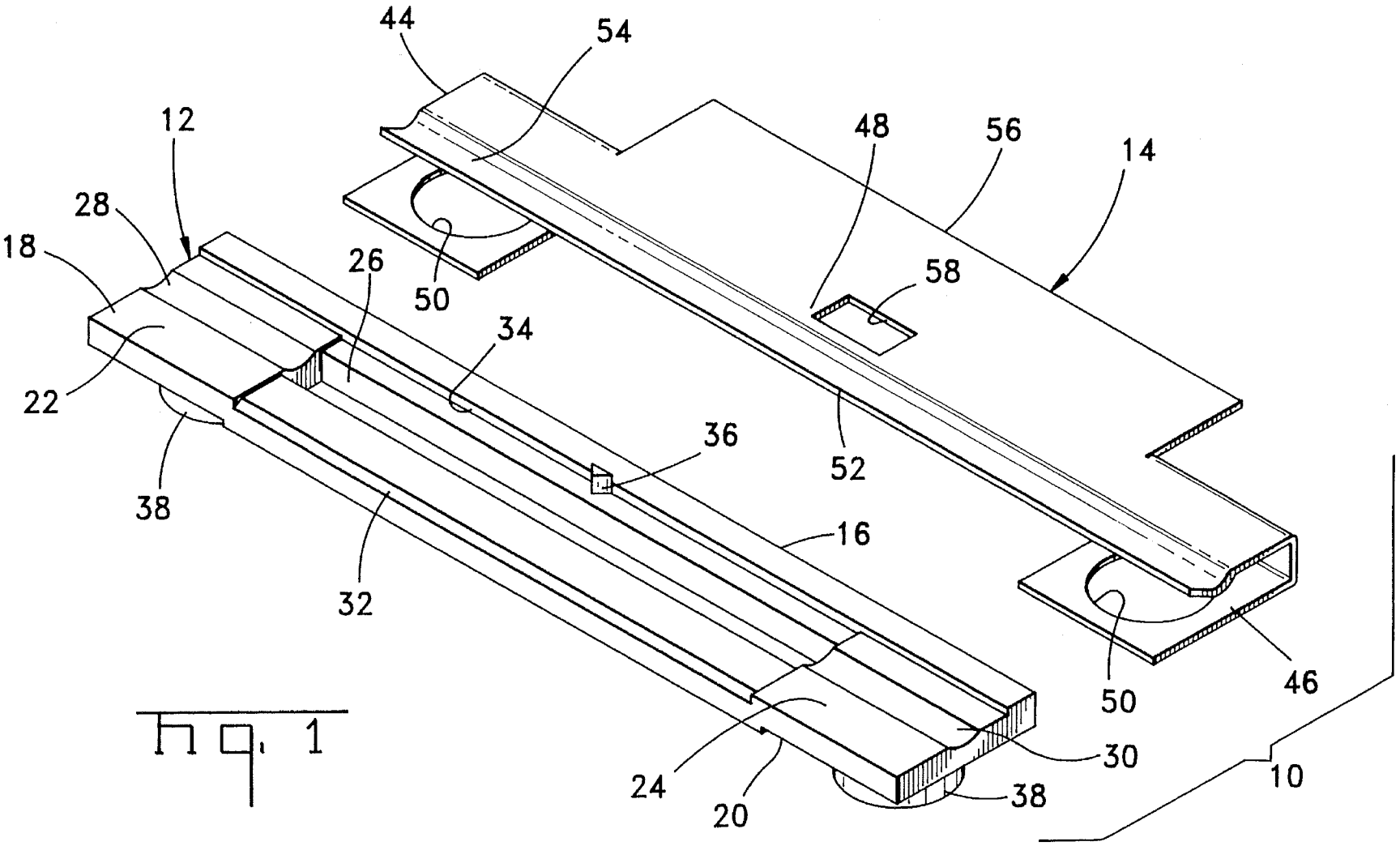
FIG. 1 is an exploded, perspective view of a connector housing and spring member forming a low profile connector for receiving a flexible film having electrical circuitry thereon for electrical interconnection to a planar electronic device, such as a printed circuit board (PCB), according to this invention.
Figure 2:
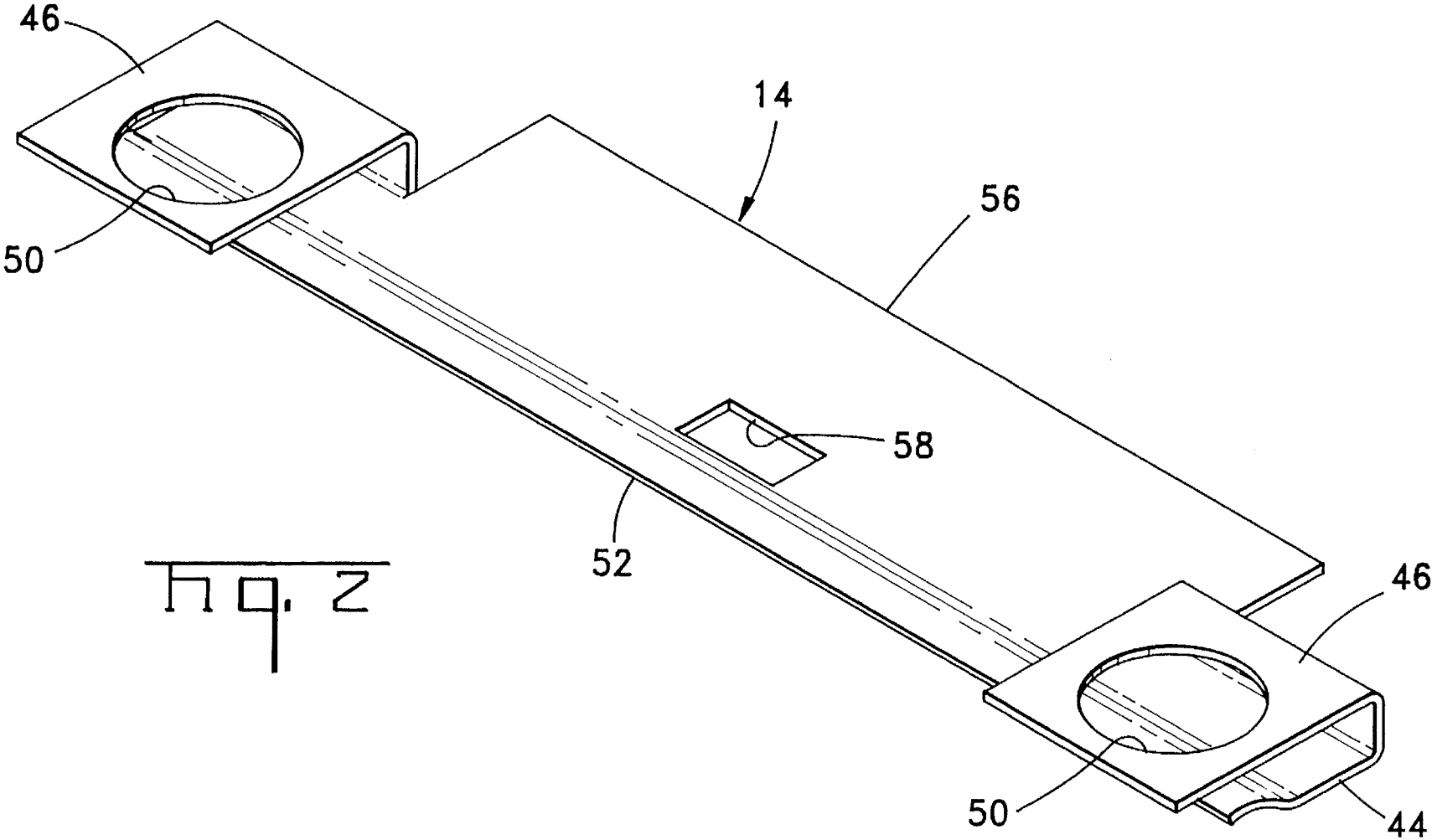
FIG. 2 is a perspective view, as viewed from the underside, of spring member illustrated in FIG. 1.

Turning now to the construction and design of the low profile electrical connector 10 of this invention, FIG. 1 illustrates a dielectric housing 12 and a spring member 14 arranged to be mounted thereon. The housing 12 comprises an elongated body 16 defined by upper and lower parallel surfaces 18,20, end portions 22,24 and a longitudinal, through slot 26 between said end portions. The respective end portions 22,24, along the upper surface 18, are provided with longitudinal recesses 28,30 for receiving an end of the spring member 14. The housing 12 is further characterized by a tapered entry edge 32 to facilitate feeding of a flexible film to the housing, and a longitudinally arranged shoulder 34 which provides a stop for said flexible film. Additionally, the shoulder 34 may include an alignment post 36 centrally thereof.

Projecting from the lower surface 20 a pair of mounting guide bosses 38 may be provided, which, as illustrated in FIG. 3, include fastening means 40 for mounting the housing 12 to a PCB 42.

A second major component of the connector of this invention is the spring member 14. Such member, stamped and formed from a sheet metal blank, preferably a spring steel, comprises a pair of opposing end portions 44,46, adapted to be received on the housing end portions 22,24, and a central actuator portion 48. The respective end portions 44,46 include openings 50 of a size and dimension to be received on the guide bosses 38. Along a forward edge 52, the spring member 14 includes a curved pressure applying channel 54, where the respective ends thereof are arranged to seat in the recesses 28,30. Continuing rearwardly from the central actuator portion 48 is a planar extension 56, the purpose of which will be apparent in the description which follows. Finally, to provide visual confirmation of the proper seating and alignment of the flexible film to be inserted therein, a window 58 may be provided to overlie the alignment post 36, se FIG. 3.

FIGS. 4 and 5 illustrate clearly the very low profile of the connector of this invention, by showing the loading and securing, respectively, of a flexible film 60 in the said connector. Further, the respective Figures show the incorporation therein of an elastomeric electrical connector 62, such as an AMPLIFLEX connector, where an undercut 64 has been provided in the housing to receive the tail 66 of the elastomeric electrical connector 62. In FIG. 4, the planar extension 56 may be depressed (note the direction arrow) whereby to open or spread the spring member 14. This allows for the lateral loading of the flexible film 60 into the connector. By releasing the spring member 14 (FIG. 5), the planar extension 56 resiles to its securing position capturing the flexible film 60 and applying a normal force thereto against the elastomeric electrical connector 62. Note that the shape of the elastomeric electrical connector is altered to show its compression between the circuitry of the flexible film 60 and corresponding electrical circuitry or traces 68 on the PCB.

Figure 7:
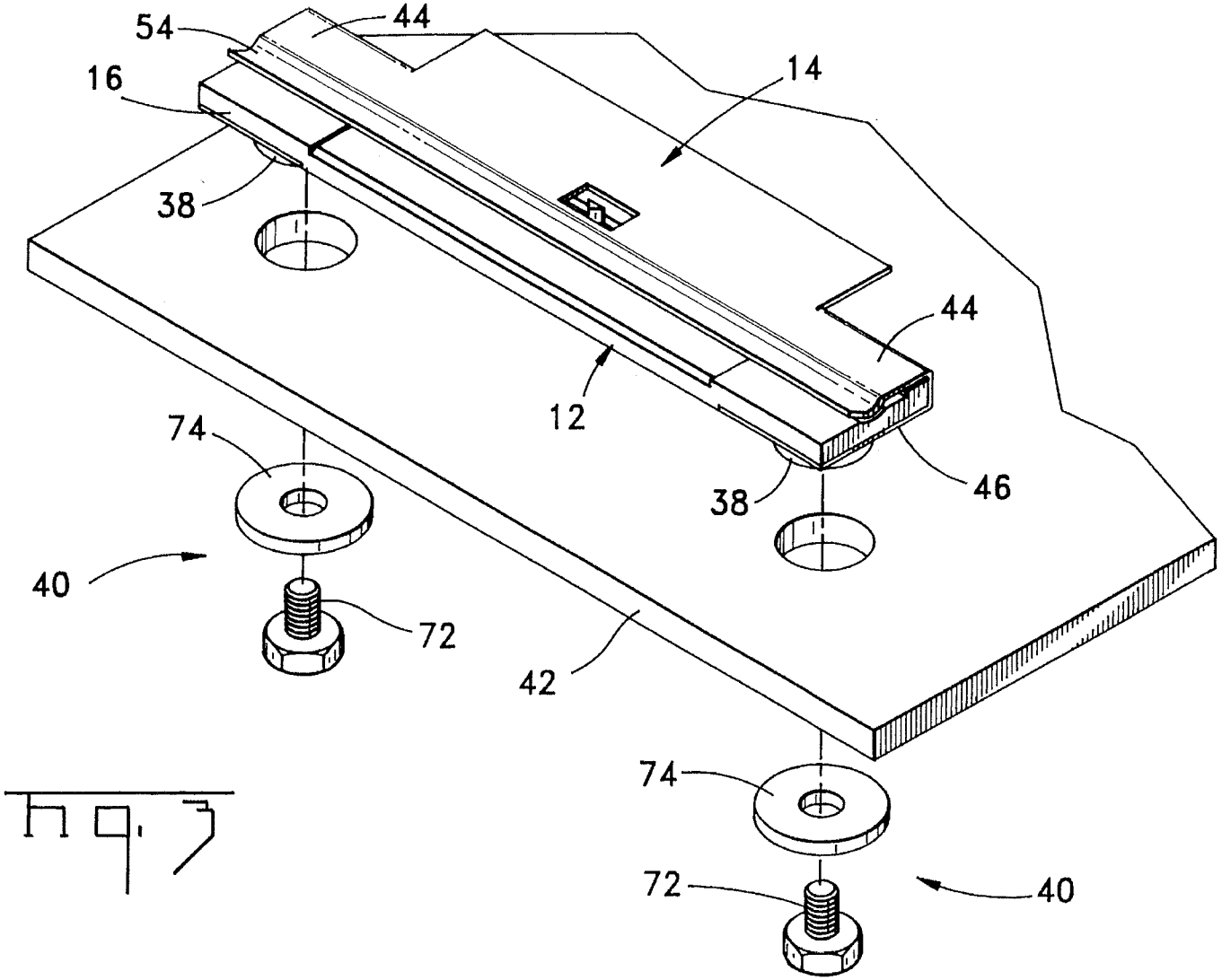
FIGS. 6 and 7 are partial, longitudinal sectional views showing preassembled and assembled positions, respectively, of the connector of this invention.
Figure 6:
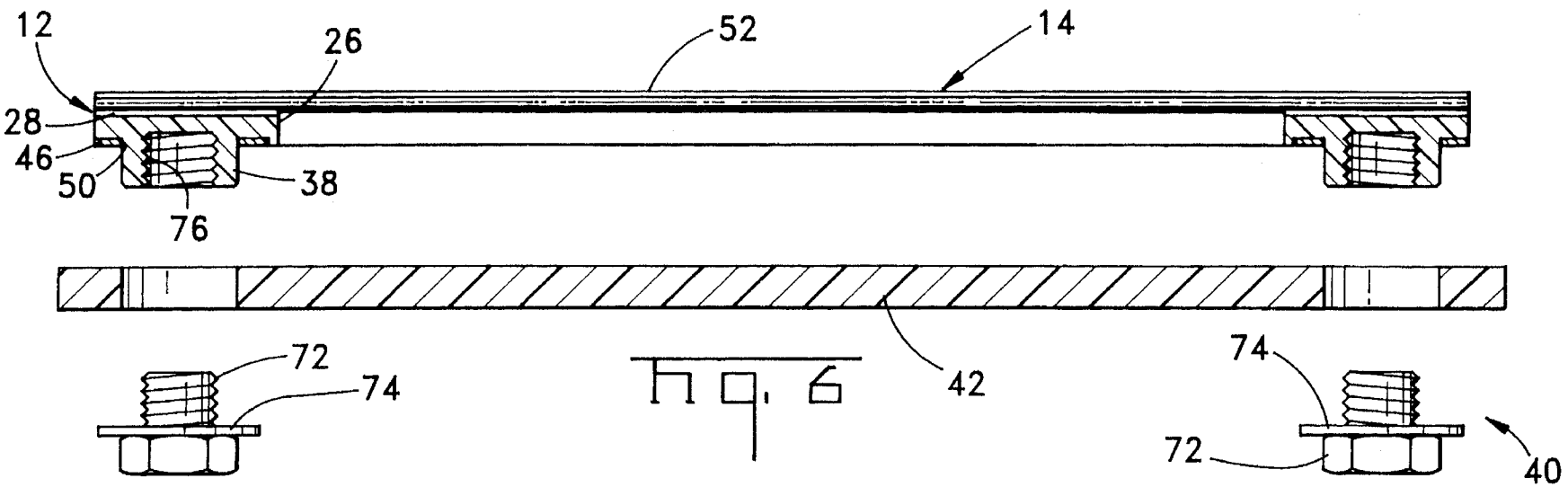
Figure 7:
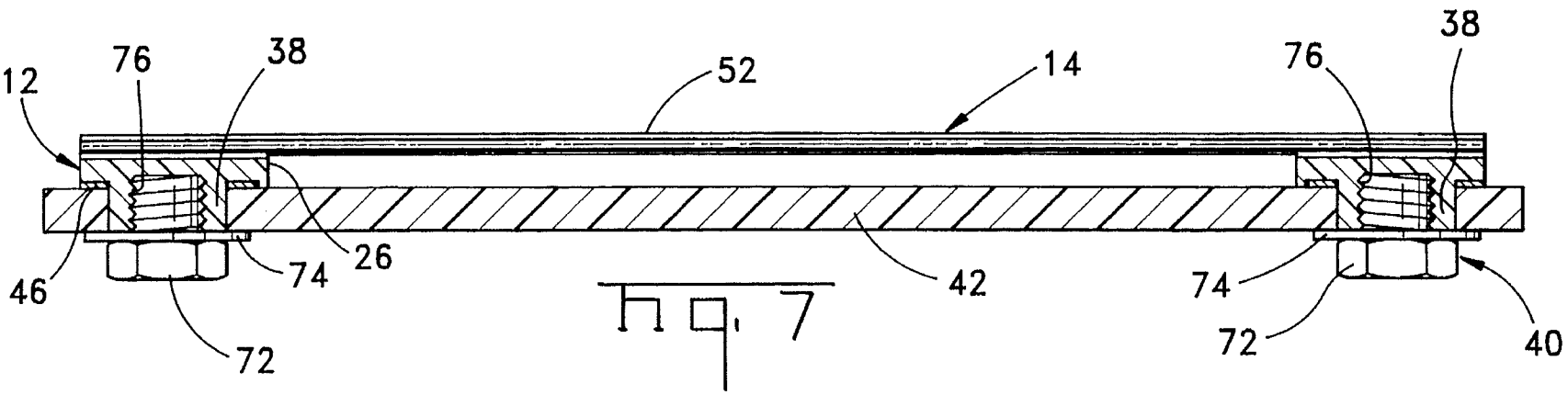

FIGS. 6 and 7, respectively, illustrate the manner of mounting the connector hereof to the planar electronic device, such as PCB 42. Specifically, fastening means 40 comprises a pair of headed, threaded fasteners 72, in combination with washers 74, which are threaded into complementary threaded holes 76 in the guide bosses 38.

We claim:

1. A low profile electrical connector for mounting a flexible film having circuitry thereon for electrical interconnection to a planar electronic device upon which said connector is to be mounted, said connector comprising (a) an elongated dielectric housing, defined by essentially upper and lower parallel surfaces, a central through slot extending between said upper and lower surfaces and end portions for receiving an electrical interface member, means for mounting said housing to said planar electronic device, and means along one of said surfaces for receiving a spring actuator member, (b) a spring actuator member comprising a stamped and formed metal member channel shaped at its ends to slidably receive said end portions of said dielectric housing, and a mid portion having an extension therefrom adapted to be deflected to effect opening or spreading of said end portions, and (c) an elastomeric connector comprising an elastomeric core having a flexible film wrapped thereabout, where said film includes electrical circuitry thereon, said elastomeric connector positioned within said central through slot to electrically interconnect a flexible film disposed within said low profile connector to said planar electronic device.

2. The low profile electrical connector according to claim 1, wherein said means along a surface of said housing includes a groove for receiving a complementary grooved portion of said spring actuator member.

3. The low profile electrical connector according to claim 2, wherein said spring actuator member includes a U-shaped formed edge along one longitudinal edge thereof remote from said extension.

4. The low profile electrical connector according to claim 1 including means for aligning said flexible film within said electrical connector.

5. The low profile electrical connector according to claim 1, wherein said elastomeric connector is secured to said dielectric housing for movement within said central through slot.

6. The low profile electrical connector according to claim 1, wherein said housing end portions include longitudinally extending grooves aligned with said central through slot to receive an end portion of said spring actuator member.

7. The low profile electrical connector according to claim 3, wherein manual depression of said extension allows for the insertion of said flexible film into said connector in contact with said formed edge.

8. The low profile electrical connector according to claim 7, wherein a resiled spring actuator member effects a normal force from said forward edge to said elastomeric connector.

* * * * *